US008651475B2

(12) United States Patent
Matsui

(10) Patent No.: US 8,651,475 B2
(45) Date of Patent: Feb. 18, 2014

(54) SHEET FEEDING APPARATUS FOR FEEDING SHEET, AND IMAGE FORMING APPARATUS HAVING SHEET FEEDING APPARATUS

(75) Inventor: Noriaki Matsui, Kashiwa (JP)

(73) Assignee: Canon Kabushiki Kaisha (JP)

( * ) Notice: Subject to any disclaimer, the term of this patent is extended or adjusted under 35 U.S.C. 154(b) by 369 days.

(21) Appl. No.: 12/844,573

(22) Filed: Jul. 27, 2010

(65) Prior Publication Data

US 2011/0024979 A1 Feb. 3, 2011

(30) Foreign Application Priority Data

Jul. 28, 2009 (JP) ..... 2009-175487
Jul. 13, 2010 (JP) ..... 2010-158777

(51) Int. Cl.
*B65H 3/06* (2006.01)

(52) U.S. Cl.
USPC ..... 271/114; 271/117

(58) Field of Classification Search
USPC ..... 271/114, 117, 118, 147, 121, 122, 124
See application file for complete search history.

(56) References Cited

U.S. PATENT DOCUMENTS 5,213,426 A * 5/1993 Ewing ..... 400/624
5,419,543 A * 5/1995 Nakamura et al. ..... 271/9.01

FOREIGN PATENT DOCUMENTS

JP 2002-321837 * 11/2002
JP 2002-366001 A 12/2002

* cited by examiner

*Primary Examiner* — Thomas Morrison
(74) *Attorney, Agent, or Firm* — Rossi, Kimms & McDowell LLP

(57) ABSTRACT

A sheet feeding apparatus that is capable of driving a motor without causing step-out even when a cheap PM type stepping motor is used for a sheet feeding unit. A sheet feeding unit includes a tray that stacks sheets, a sheet feeding mechanism that conveys the sheets, a lifting mechanism that lifts the tray, a stepping motor that drives the sheet feeding mechanism and the lifting mechanism, and a switching mechanism that switches an operation of the sheet feeding mechanism and an operation of the lifting mechanism according to a rotating direction of the stepping motor. A control unit changes the number of pulses of initialization of the stepping motor according to whether the sheet to be fed is a sheet after excitation current for the stepping motor is switched on from off and whether the lifting mechanism operates after feeding a previous sheet.

10 Claims, 15 Drawing Sheets

TIMING CHART AT TIME OF PAPER FEED CONTROL (CASE OF ON IN S301, FLG=0)

SHEET FEEDING APPARATUS FOR FEEDING SHEET, AND IMAGE FORMING APPARATUS HAVING SHEET FEEDING APPARATUS

BACKGROUND OF THE INVENTION

1. Field of the Invention

The present invention relates to a sheet feeding apparatus for feeding a sheet, and an image forming apparatus having the sheet feeding apparatus. And particularly, the present invention relates to drive control for a sheet feeding motor that is mounted in the sheet feeding apparatus.

2. Description of the Related Art

In an image forming apparatus of a high-speed electrophotography system with many printouts per unit time, it is necessary to control a sheet conveyance operation accurately and to maintain stability of high-speed sheet conveyance. In order to achieve such a high-speed sheet conveyance, a hybrid type stepping motor of high torque and high speed is used conventionally.

A cheap and efficient PM type stepping motor is now being developed. For example, Japanese Laid-Open Patent Publication (Kokai) No. 2002-366001 (JP 2002-366001A) discloses a method for controlling to drive a cheap PM type stepping motor without causing step-out. In this method, an initial operation, which rotates a motor by a phase signal of at least one or more patterns of excitation patterns repeated at a frequency within a self-starting range, is executed when starting the motor at a beginning after excitation current for the motor has been severed after power-on of a printer due to a certain event. For example, when starting a sheet conveyance operation, the phase of the motor is synchronized with the phase of the phase signal, and the printer is shifted to a paper feeding operation immediately after the above-mentioned initial operation.

However, a cheap PM type stepping motor cannot withstand a rapid torque variation. Therefore, when one object is driven by a normal rotation of the motor and another object is driven by a reverse rotation of the motor, the motor tends to cause step-out due to a backlash of a mechanical gear, etc.

In order to prevent the step-out, although it is effective to increase the number of the excitation patterns repeated at the frequency within the self-starting range, the increase of the number of the excitation patterns extends standby time, which causes a problem to decrease productivity of a print process.

SUMMARY OF THE INVENTION

The present invention provides a sheet feeding apparatus and an image forming apparatus having the sheet feeding apparatus that are capable of driving a motor without causing step-out even when a cheap PM type stepping motor is used for a sheet feeding unit.

Accordingly, a first aspect of the present invention provides a sheet feeding apparatus that feeds a sheet, comprising a sheet feeding unit configured to include a tray that stacks sheets to be fed, a sheet feeding mechanism that conveys the sheets stacked on the tray on a one-by-one basis, a lifting mechanism that lifts the tray so that the sheet is positioned in a sheet feeding position suitable for feeding, a stepping motor that drives the sheet feeding mechanism and the lifting mechanism, and a switching mechanism that switches an operation of the sheet feeding mechanism and an operation of the lifting mechanism according to a rotating direction of the stepping motor; and a control unit configured to control said sheet feeding unit, wherein said control unit executes a first initial operation in which the stepping motor is driven at an initial starting speed until the number of pulses reaches a first pulse number, and then, changes the speed of the stepping motor to a sheet feeding speed, when the sheet feeding mechanism feeds a sheet after excitation current for the stepping motor is switched on from off, wherein said control unit executes a second initial operation in which the stepping motor is driven at the initial starting speed until the number of pulses reaches a second pulse number, and then, changes the speed of the stepping motor to the sheet feeding speed, when the sheet feeding mechanism feeds a sheet without turning off the excitation current for the stepping motor after the lifting mechanism lifts the tray, and wherein said control unit changes the speed of the stepping motor from the initial starting speed to the sheet feeding speed without executing the first and second initial operations, when the sheet feeding mechanism feeds a sheet without turning off the excitation current for the stepping motor after the sheet feeding mechanism feeds a previous sheet.

Accordingly, a second aspect of the present invention provides A sheet feeding apparatus that feeds a sheet, comprising a sheet feeding unit configured to include a tray that stacks sheets to be fed, a sheet feeding mechanism that conveys the sheets stacked on the tray on a one-by-one basis, a lifting mechanism that lifts the tray so that the sheet is positioned in a sheet feeding position suitable for feeding, a stepping motor that drives the sheet feeding mechanism and the lifting mechanism, and a switching mechanism that switches an operation of the sheet feeding mechanism and an operation of the lifting mechanism according to a rotating direction of the stepping motor; and a control unit configured to control said sheet feeding unit, wherein said control unit drives the stepping motor at an initial starting speed until the number of pulses reaches a first pulse number, and then, changes the speed of the stepping motor to a sheet feeding speed, when the sheet feeding mechanism feeds a sheet after excitation current for the stepping motor is switched on from off, wherein said control unit drives the stepping motor at the initial starting speed until the number of pulses reaches a second pulse number, and then, changes the speed of the stepping motor to the sheet feeding speed, when the sheet feeding mechanism feeds a sheet without turning off the excitation current for the stepping motor after the lifting mechanism lifts the tray, and wherein said control unit drives the stepping motor at the initial starting speed until the number of pulses reaches a third pulse number, and then, changes the speed of the stepping motor to the sheet feeding speed, when the sheet feeding mechanism feeds a sheet without turning off the excitation current for the stepping motor after the sheet feeding mechanism feeds a previous sheet.

Further features of the present invention will become apparent from the following description of exemplary embodiments with reference to the attached drawings.

DESCRIPTION OF THE EMBODIMENTS

Hereafter, embodiments according to the present invention will be described in detail with reference to the drawings.

Figure 1:
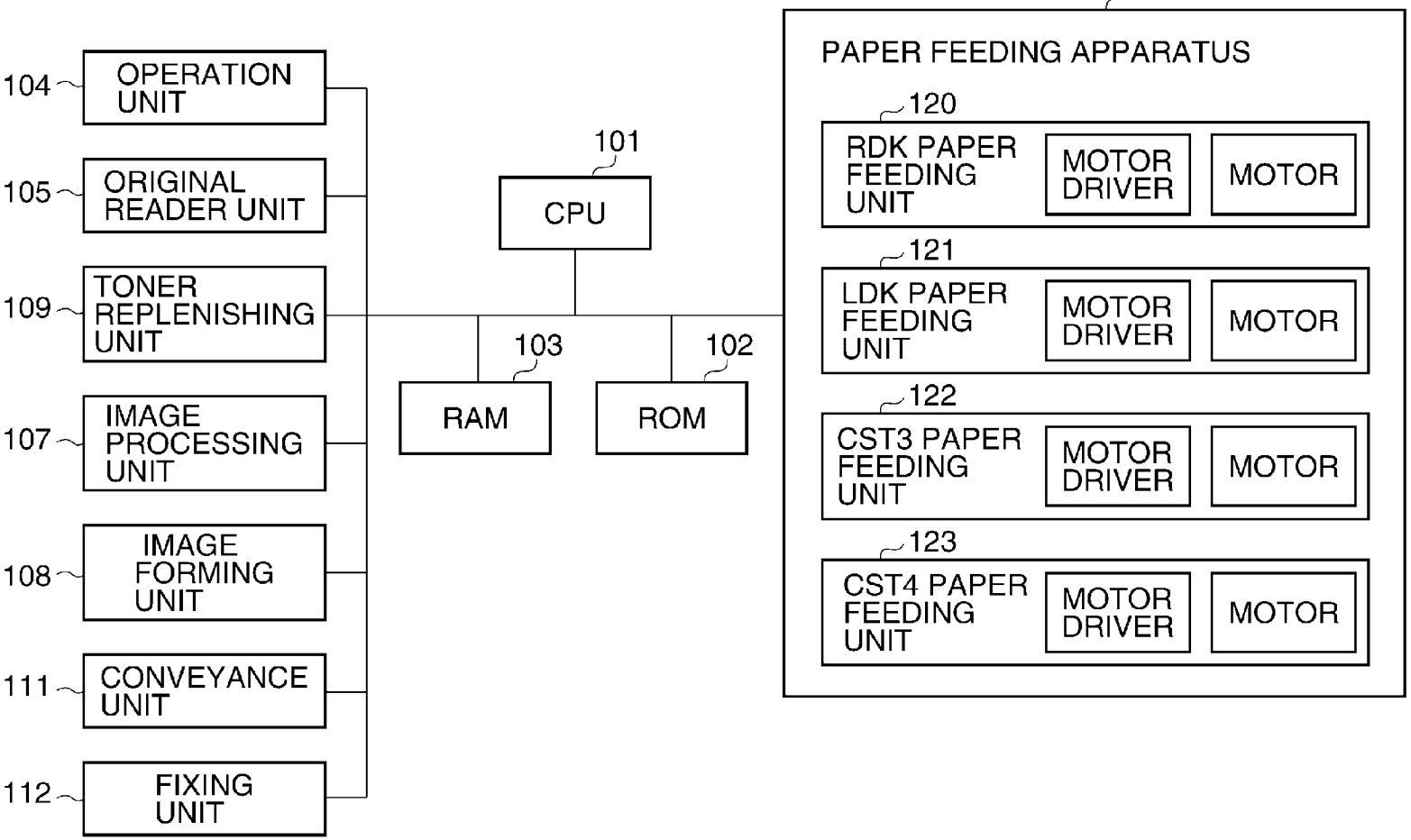
FIG. 1 is a block diagram schematically showing a functional configuration of a digital copier that is an example of an image forming apparatus including a sheet feeding apparatus according to an embodiment of the present invention.

FIG. 1 is a block diagram schematically showing a functional configuration of a digital copier that is an example of an image forming apparatus including a sheet feeding apparatus according to an embodiment of the present invention.

In FIG. 1, a CPU (Central Processing Unit) 101 controls a plurality of function units with which the digital copier is provided. A ROM (Read Only Memory) 102 stores a control program etc. that the CPU 101 should execute. A RAM (Random Access Memory) 103 is used as a working area required for the CPU 101 to control the digital copier. The RAM 103 is used also for storing the digital image etc. of an original read by an original reader unit 105. The RAM 103 is used also as a working area required in order that an image processing unit 107 applies an image process to a digital image obtained from the original reader unit 105.

An operation unit 104 is provided with a display panel, operation key, buttons, etc., and can set up a copy job that a user wants to execute by the digital copier, for example. The original reader unit 105 reads an image of an original placed on a platen glass (see FIG. 2) of the digital copier by an operation from the operation unit 104, digitizes the image, and stores the digital image into the RAM 103.

The image processing unit 107 applies a necessary image process to the digital image and stores the digital image that should be formed into the RAM 103 according to the copy job settings, such as a setting of single-side printing/double-side printing, from the operation unit 104 and contents of the read image from the original reader unit 105. An image forming unit 108 forms a toner image based on the digital image stored in the RAM 103. A toner replenishing unit 109 suitably supplies toner consumed by the image forming unit 108 from a toner cartridge.

A sheet (it is also only referred to as "paper") stacked inside the digital copier is fed by a paper feeding apparatus 110, and is conveyed to the image forming unit 108 by a conveyance unit 111. The toner image formed by the image forming unit 108 is transferred onto the sheet. The sheet on which the toner image has been transferred is fixed by a fixing unit 112, and is ejected outside the copier as-is, or is again conveyed towards the image forming unit 108 by the conveyance unit 111 in order to form a second image.

The paper feeding apparatus 110 is divided into an RDK paper feeding unit 120, an LDK paper feeding unit 121, a CST3 paper feeding unit 122, and a CST4 paper feeding unit 123 so that a plurality of paper feeding units (sheet feeding units) with which a digital multifunctional peripheral device is provided can be controlled individually. Each of the RDK paper feeding unit 120, the LDK paper feeding unit 121, the CST3 paper feeding unit 122, and the CST4 paper feeding unit 123 is provided with a motor driver and a motor. The motor driver is possible to switch a direction of rotation of the motor between a normal direction and a reverse direction, and is possible to set drive frequency of the motor. The motor of each paper feeding unit is a 2-phase PM type stepping motor, and the driver is configured so that the excitation pattern for the stepping motor varies according to a clock pulse inputted into the stepping motor.

Figure 2:
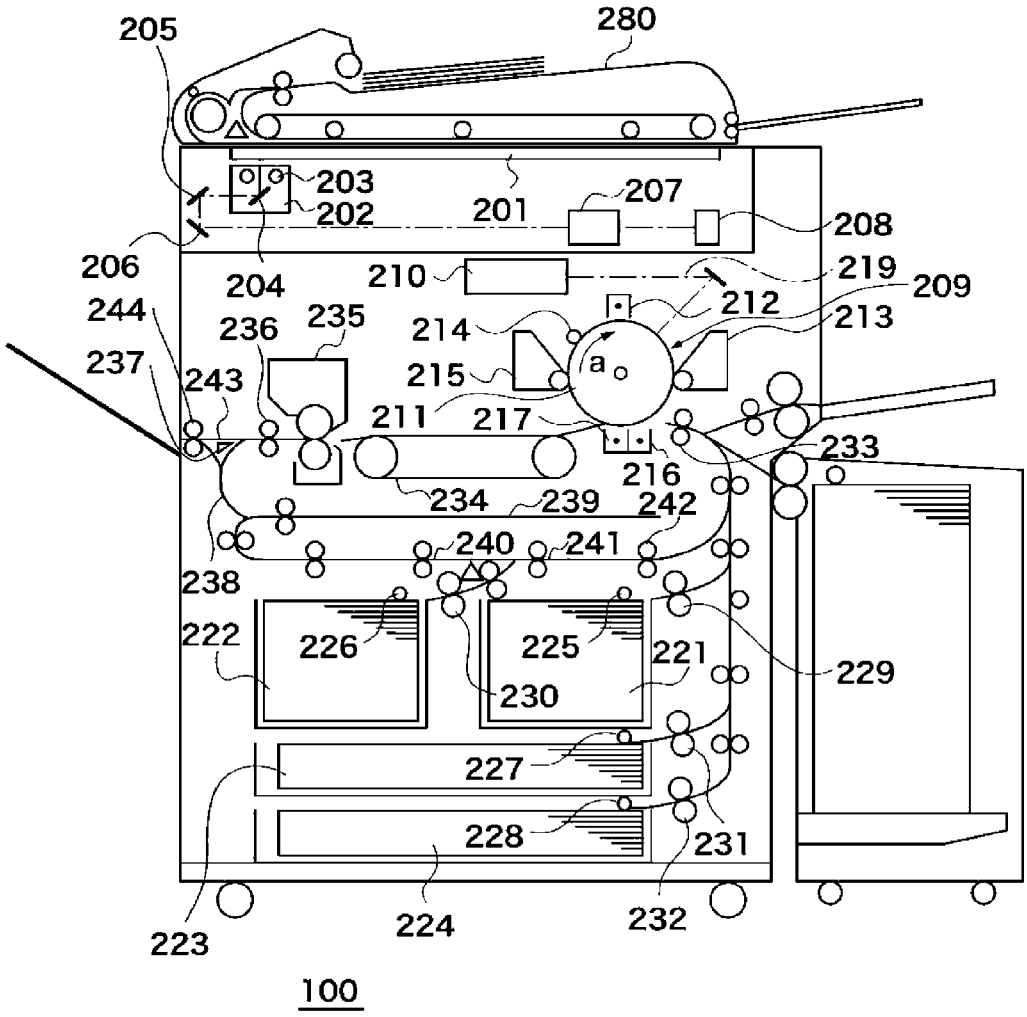
FIG. 2 is a longitudinal sectional view schematically showing a configuration of the digital copier shown in FIG. 1.

FIG. 2 is a longitudinal sectional view schematically showing a configuration of the digital copier shown in FIG. 1.

In the digital multifunctional peripheral device, an automatic document feeder (ADF) 280, a platen glass 201, a scanner 202, etc. are arranged in an upper portion of an apparatus body 100. The scanner 202 is provided with a document illumination lamp 203, a scanning mirror 204, etc., and reciprocates in a predetermined direction by a motor (not shown). Reflected light from an original is reflected by scanning mirrors 204 through 206, and is refracted by a lens 207 to form an image on a CCD sensor inside the image sensing unit 208. The above-mentioned operations are controlled by the original reader unit 105.

An exposure control unit 210 comprises a laser, a polygon scanner, etc., and irradiates a photoconductive drum 211 with a laser beam 219 that is modulated based on an image signal that is converted into an electric signal by the image sensing unit 208 and is processed by applying a predetermined image process. Around the photoconductive drum 211, a primary electrostatic charger 212, a development device 213, a transferring charging unit 216, a pre-exposure lamp 214, and a cleaning device 215 are arranged.

In an image forming mechanism 209, the photoconductive drum 211, which is rotating in a direction shown by an arrow in the figure by a motor (not shown), is charged at a desired potential by the primary electrostatic charger 212, and then, the laser beam 219 from the exposure control unit 210 is irradiated to form an electrostatic latent image. The electrostatic latent image formed on the photoconductive drum 211 is developed by the development device 213, and is visualized as a toner image. The above-mentioned operations are controlled by the image forming unit 108.

A sheet that is fed by a pickup roller 225, 226, 227, or 228 from a right cassette deck 221, a left cassette deck 222, a upper cassette 223, or a lower cassette 224 is sent to a conveyance path by a paper feeding roller pair 229, 230, 231, or 232. The above-mentioned operations are controlled by the paper feeding apparatus 110. Each of the RDK paper feeding unit 120, the LDK paper feeding unit 121, the CST3 paper feeding unit 122, and the CST4 paper feeding unit 123 performs a lifter control and a paper feeding operation. The RDK paper feeding unit 120 controls a paper feeding from the right cassette deck 221, the LDK paper feeding unit 121 controls a paper feeding from the left cassette deck 222, the CST3 paper feeding unit 122 controls a paper feeding from the upper cassette 223, and the CST4 paper feeding unit 123 controls a paper feeding from the lower cassette 224.

The sheet is bent so as to form a loop by a registration roller pair 233, and stops. This performs a registration adjustment of the sheet. After the registration adjustment of the sheet, the sheet is sent to a transfer section by the registration roller pair 233, and the toner image formed on the photoconductive drum 211 is transferred onto the sheet by the transferring charging unit 216. After transferring the toner image, the residual toner on the photoconductive drum 211 is cleaned by the cleaning device 215, and the residual charge is eliminated by the pre-exposure lamp 214. The above-mentioned operations are controlled by the image forming unit 108.

The sheet after transfer is dissociated from the photoconductive drum 211 by a separating electrostatic charger 217, and is sent to a fixing unit 235 as-is by a transportation belt 234. The fixing unit 235 pressurizes and heats the sent sheet to fix the toner image. The sheet on which the toner image is fixed is ejected to the outside of the apparatus body 100 by an inner paper eject roller pair 236 and an eject roller pair 244.

A conveyance path of the sheet conveyed by the inner paper eject roller pair 236 is switched between a conveyance path 238 and an eject path 243 by a paper eject flapper 237. A lower conveyance path 240 turns over the sheet sent out from the inner paper eject roller pair 236 via a reversal path 239, and guides the sheet to a paper re-feeding path 241. A sheet fed by the paper feeding roller pair 230 from the left cassette deck 222 is also guided to the paper re-feeding path 241.

A paper re-feeding roller pair 242 re-feeds the sheet to the image forming mechanism 209. The eject roller pair 244 is arranged near the paper eject flapper 237, and discharges the sheet switched to the eject path 243 by the paper eject flapper 237 to the outside of the apparatus body 100. The above-mentioned operations are controlled by the conveyance unit 111 and the fixing unit 112.

Next, the configuration of the paper feeding apparatus 110 will be described.

Figure 3:
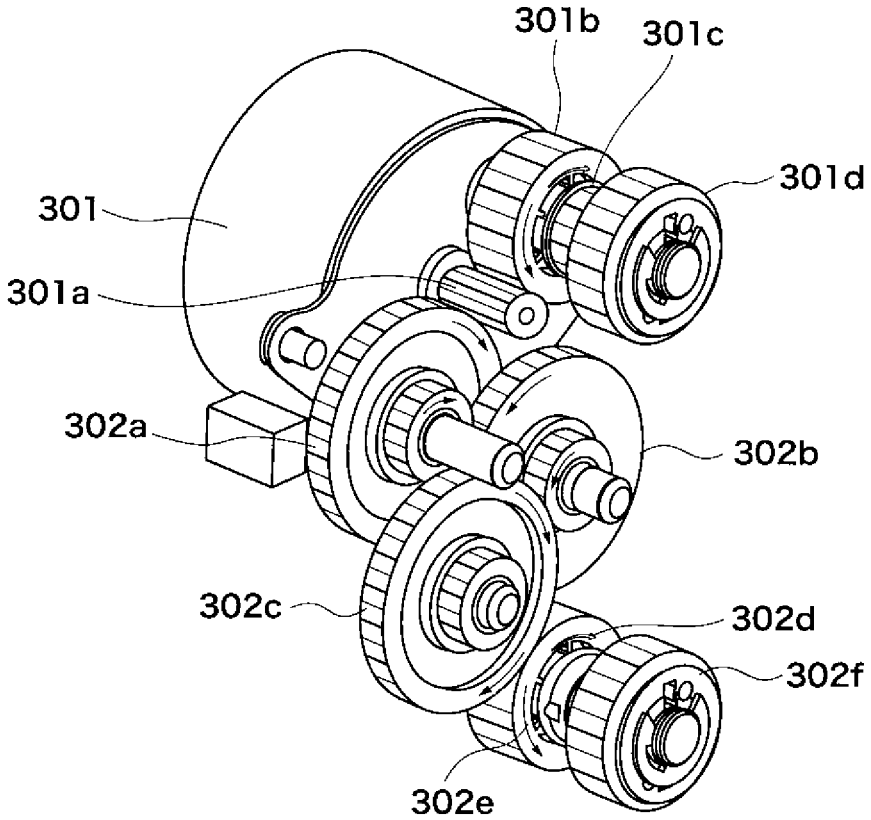
FIG. 3 is a perspective view showing a paper feeding drive transmission unit in a paper feeding unit of the digital copier in FIG. 1.
Figure 4:
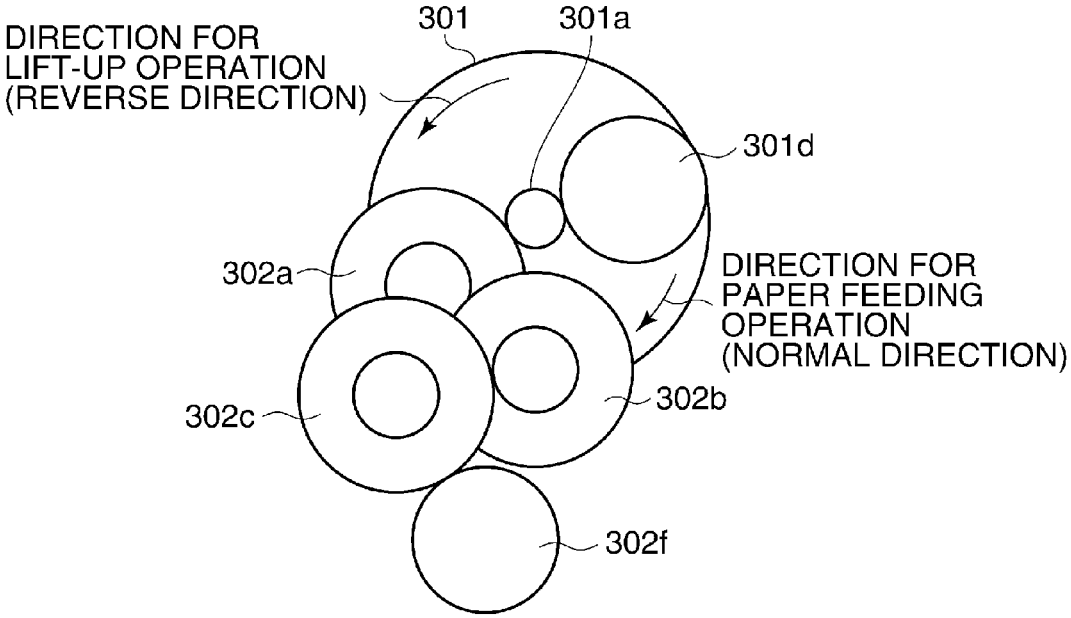
FIG. 4 is a plan view schematically showing a gear arrangement of the paper feeding drive transmission unit shown in FIG. 3.

FIG. 3 is a perspective view of the paper feeding drive transmission unit in the paper feeding apparatus 110. FIG. 4 is a plan view schematically showing a gear arrangement of the paper feeding drive transmission unit shown in FIG. 3. It should be noted that the paper feeding drive transmission unit is not limited to the example shown in the figure, and it may have other constructions and configurations.

In the paper feeding apparatus 110, each of the RDK paper feeding unit 120, the LDK paper feeding unit 121, the CST3 paper feeding unit 122, and the CST4 paper feeding unit 123 is provided with the paper feeding drive transmission unit shown in FIG. 3. The paper feeding drive transmission unit transfers a drive power so as to feed a sheet by rotating a drive shaft 301*a* of a paper feeding motor 301 in a normal direction, and transfers a drive power so that a lifting mechanism of each paper feeding unit lifts a sheet bunch up towards a paper feeding position (a sheet feeding position) suitable for feeding paper by rotating the drive shaft 301*a* in a reverse direction. For example, as shown in FIG. 4, a rotation of the drive shaft 301*a* of the paper feeding motor 301 in a clockwise direction is a normal rotation, and a rotation in a counter-clockwise direction is a reverse rotation. Thus, the paper feeding drive transmission unit functions as a switching mechanism for switching a paper feeding operation and a lift-up operation according to the rotating direction of the paper feeding motor 301.

The drive shaft 301*a* of the paper feeding motor 301 is always connected with a paper feeding connecting gear 301*b*, a first lifter connecting gear 302*a*, a second lifter connecting gear 302*b*, a third lifter connecting gear 302*c*, and a fourth lifter connecting gear 302*d* in order to transfer the drive power. During the lift-up operation, the fourth lifter connecting gear 302*d* is connected with a lifter driving gear 302*f* by an one-way gear 302*e* (lifter drive, an example of a lifting mechanism).

On the other hand, during the paper feeding operation, the fourth lifter connecting gear 302*d* is connected to the paper feeding connecting gear 301*b* by an one-way gear 301*c* (paper feeding drive). The one-way gears 301*c* and 302*e* slip and do not transfer the driving power when rotating in the reverse direction as with a general one-way gear. Although the driving power is not transferred, the one-way gear rotates. Therefore, when transferring the driving power in the next time, mesh of the gears will be in bad condition (there is a gear gap), and backlash will be generated. The paper feeding motor may step out due to the backlash.

Figure 5:
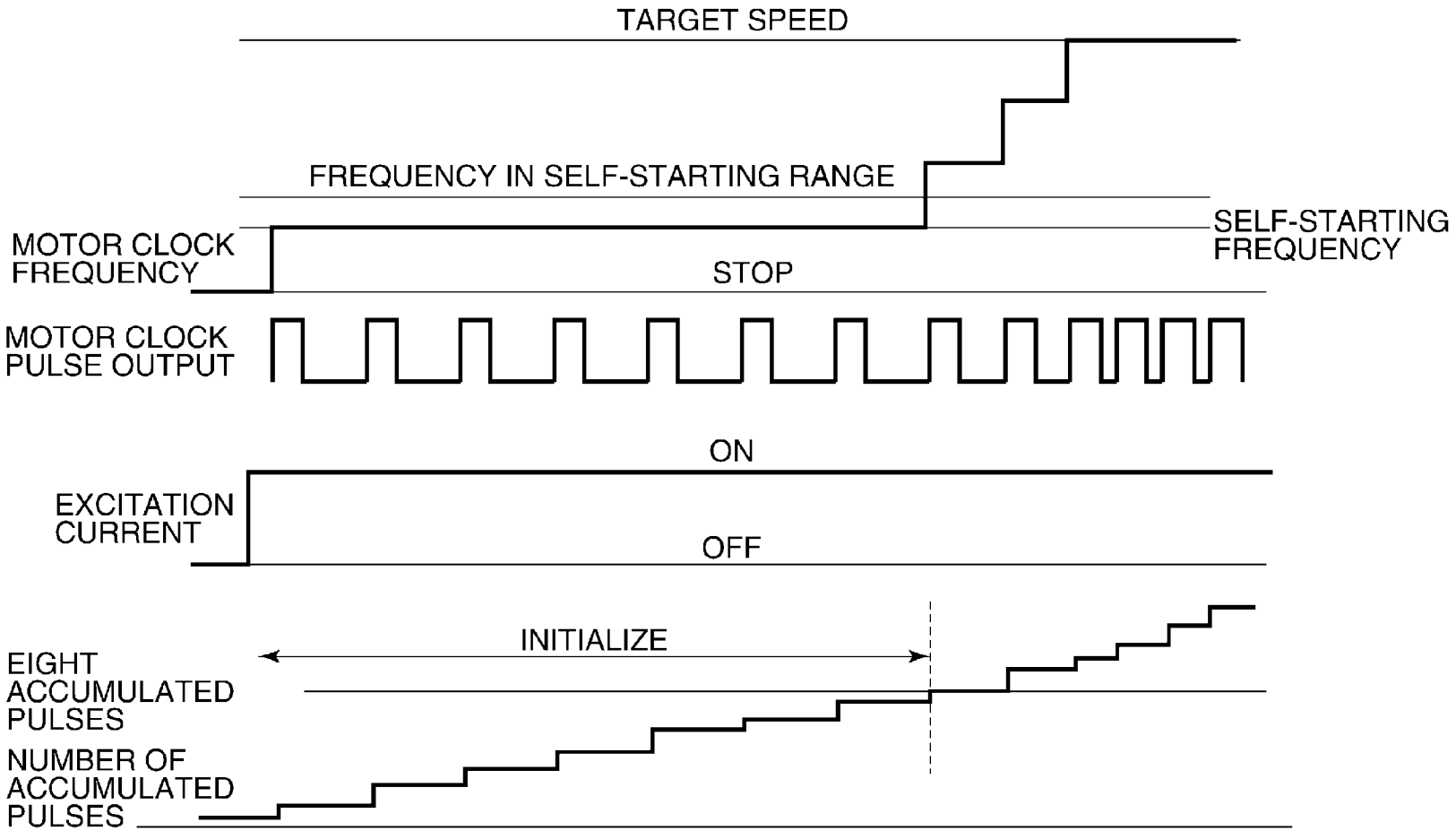
FIG. 5 is a view showing a relationship between motor clock frequency, a motor clock pulse output, excitation current, and a number of accumulated clock pulses when starting a paper feeding motor of the digital copier in FIG. 1.

FIG. 5 is a view showing a relationship among a motor clock frequency, a motor clock pulse output, excitation current, and a number of accumulated clock pulses when starting the paper feeding motor.

The paper feeding motor 301 is driven by increasing the motor clock frequency into a self-starting range (i.e., a self-starting frequency) that is sufficient to start the motor, after keeping a sufficient holding time from a time when the excitation current shifts to an ON condition (100% excited condition) from an OFF condition. For example, the paper feeding motor 301 is driven at the self-starting frequency until the number of accumulated clock pulses inputted into the motor becomes eight pulses, as an initial operation for the motor. Then, the motor is accelerated by shortening the interval of the clock pulse inputted into the motor to reach a target speed. In this embodiment, since a cheap PM-type-two-phase stepping motor is used by one-two phase excitation as the paper feeding motor, at least eight clocks are required so that one cycle of the excitation patterns is performed. Therefore, the number of accumulated clock pulses is set at eight pulses. However, this is an operation of an electric phase matching. If there is a gear gap, the motor should be driven at the self-starting frequency until the gear gap is removed in addition to the drive for the electric phase matching.

Figure 6A:
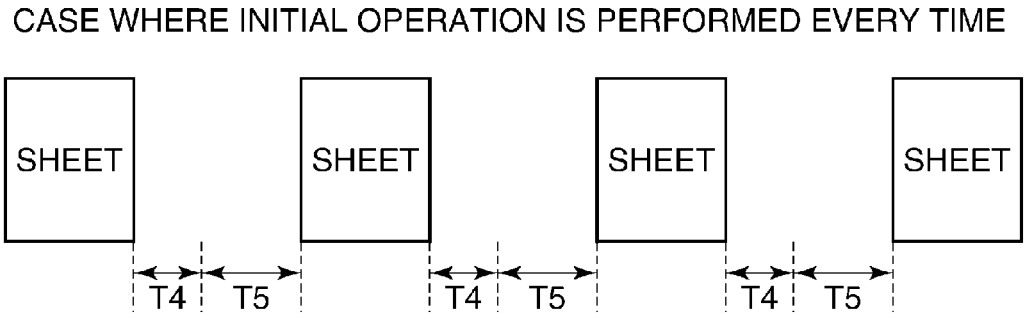
FIG. 6A is a view showing a sheet feeding timing when an initial operation is executed for every feeding operation in the digital copier in FIG. 1.
Figure 6B:
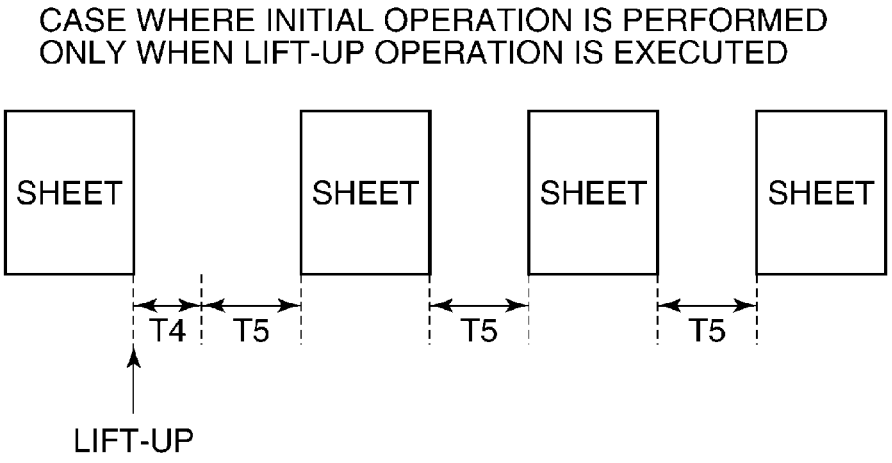
FIG. 6B is a view showing the sheet feeding timing when the initial operation is executed only when a lift-up operation is executed in the digital copier in FIG. 1.

When performing the gear gap removal and the electric phase matching every time, a sheet feeding timing becomes a pattern of "CASE WHERE INITIAL OPERATION IS PERFORMED EVERY TIME" as shown in FIG. 6A. In this case, a time (T4) required for the initial operation for the paper feeding motor and an inter-paper time (T5) will be indispensable every time. On the other hand, a pattern of "CASE WHERE INITIAL OPERATION IS PERFORMED ONLY WHEN LIFT-UP OPERATION IS EXECUTED" as shown in FIG. 63 requires the time (T4) for the initial operation for the motor only when the lift-up operation is executed at a time between papers, and only the inter-paper time (T5) is required when the lift-up operation does not executed. This shows that the pattern of "CASE WHERE INITIAL OPERATION IS PERFORMED ONLY WHEN LIFT-UP OPERATION IS EXECUTED" increases total productivity.

Next, a procedure of the drive control of the paper feeding motor 301 in this embodiment will be described using FIG. 7.

Figure 7:
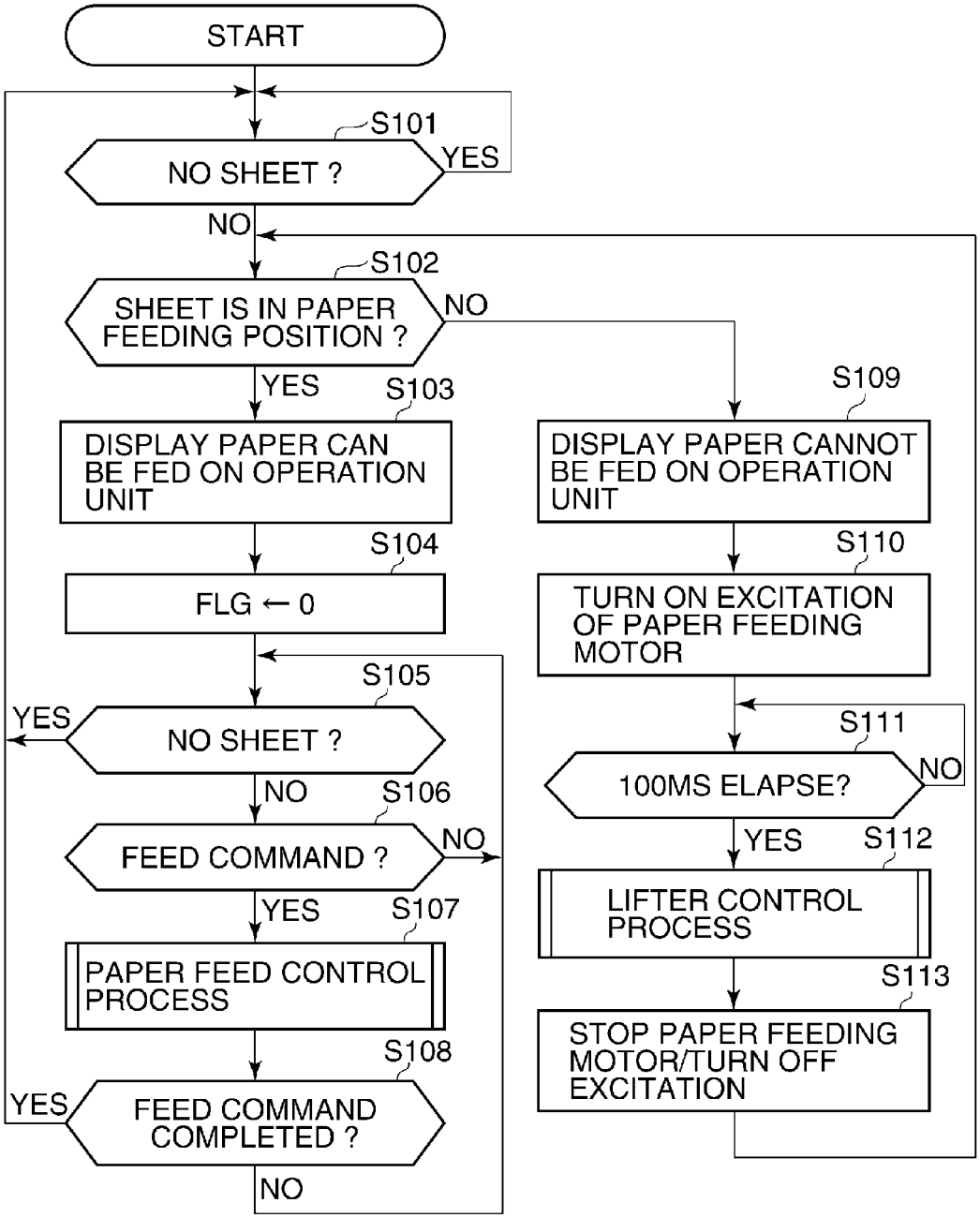
FIG. 7 is a flowchart showing an example of a drive-control process for the paper feeding motor of the digital copier in FIG. 1.

FIG. 7 is a flowchart showing an example of a drive-control process for the paper feeding motor 301. This process is achieved because the CPU 101 reads a control program from the ROM 102 etc. and executes the control program. This process is executed for each of the right cassette deck 221, the left cassette deck 222, the upper cassette 223, and the lower cassette 224 independently.

First, in step S101, the CPU 101 determines whether a sheet is stored in each of the right cassette deck 221, the left cassette deck 222, the upper cassette 223, and the lower cassette 224. When the CPU 101 determines that a sheet is stored in neither of the paper feeding units based on a detection result by a sheet detection sensor (not shown) etc. that is arranged at each paper feeding unit, the CPU 101 becomes in a standby condition until a sheet is stored in any one of the paper feeding units. It should be noted that the step S101 is executed, only when the CPU 101 determines that a door of the paper feeding unit is closed based on a detection result by an open/close sensor (not shown) etc. for the door of the paper feeding unit.

Figure 8:
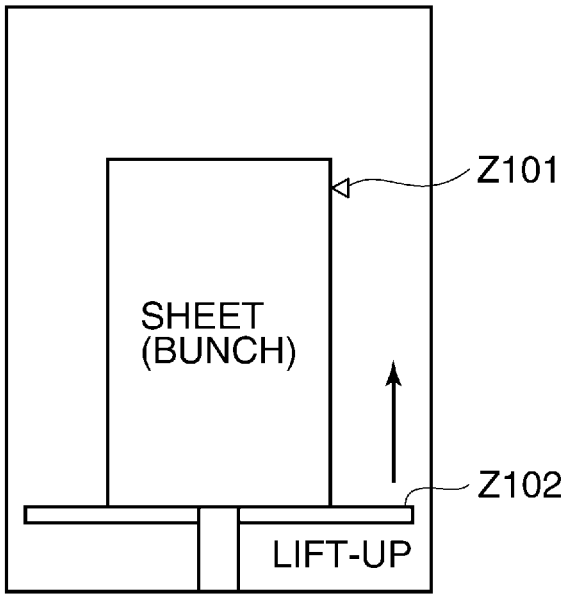
FIG. 8 is a side view showing the paper feeding unit for describing general locations of a paper detection sensor and a tray arranged for each paper feeding unit of the digital copier in FIG. 1.

When determining that there is a sheet in the step S101, the CPU 101 determines whether the sheet stored in the paper feeding unit is in a paper feeding position (step S102). When determining that the sheet is not in the paper feeding position, the CPU 101 proceeds with the process to step S109. On the other hand, when determining that the sheet is in the paper feeding position, the CPU 101 proceeds with the process to step S103. The CPU 101 determines whether the sheet is in the paper feeding position based on a detection result of a paper detection sensor arranged in the paper feeding unit. FIG. 8 is a sectional view schematically showing the paper feeding unit. It should be noted that an illustrated example is a common configuration for each paper feeding unit.

In FIG. 8, a sheet (or a sheet bunch) that is stored in the paper feeding unit is stacked on a tray 2102. The tray 2102 is lifted when the paper feeding motor 301 rotates in the reverse direction, and is controlled so that a top face position of the sheet keeps a position that is suitable for feeding the sheet based on the detection result of the paper detection sensor Z101. That is, the position of the tray 2102 is adjusted according to a loading condition (a load) of the sheet on the tray 2102. It should be noted that the paper feeding unit is configured so that the tray 2102 falls to the bottom of the paper feeding unit and then the paper feeding unit is moved frontwards, when an opening button (not shown) for opening the door is pushed.

In the step S103, the CPU 101 displays that paper can be fed from the paper feeding unit that has been confirmed to have a sheet in the step S101 on the operation unit 104. Then, the CPU 101 clears an internal flag (FLG=0) of the paper feeding unit that has been confirmed to have a sheet (step S104). This internal flag is set to "0" when the operation of the lifting mechanism is unnecessary because the sheet is in the paper feeding position, and is set to "1" when the operation of the lifting mechanism is necessary because the sheet is not in the paper feeding position. The internal flag is used to determine whether the lifting mechanism has operated before the paper feeding of this time in step S312 in FIG. 10A mentioned later.

Next, the CPU 101 determines whether there is a sheet based on the sheet detection sensor (not shown) as with the process in the step S101 (step S105). When determining there is no sheet as a result of this determination, the process is returned to the step S101. On the other hand, when determining there is a sheet, the CPU 101 proceeds with the process to step S106 and determines whether there is a feed command. The CPU 101 determines whether there is the feed command according to whether a start key (not shown) on the operation unit 104 has been pressed.

When determining there is no feed command as a result of the determination in the step S106, the process is returned to the step S105. On the other hand, when determining there is the feed command, the CPU 101 executes a paper feed control process (step S107). Details of the paper feed control process will be described below.

Next, in step S108, the CPU 101 determines whether the feed command has been completed. The CPU 101 determines whether the feed command has been completed according to whether all the print number of sheets set by the operation unit 104 has printed (a print job has completed), for example. When determining the feed command has completed as a result of the determination in the step S108, the process is returned to the step S101. On the other hand, when determining the feed command is not completed, the process is returned to the step S105.

In the step S109, the CPU 101 displays that paper cannot be fed from the paper feeding unit that has been confirmed to have a sheet in the step S101 on the operation unit 104. Next, in step S110, the CPU 101 turns ON the excitation current of the paper feeding motor 301 of the paper feeding unit that has been confirmed to have a sheet. Then, the CPU 101 waits for a lapse of 100 ms (step S111). After the lapse of 100 ms, the CPU 101 executes a lifter control process (step S112). Details of the lifter control process will be described below.

Next, in step S113, the CPU 101 issues a driving stop command to the paper feeding motor 301 of the paper feeding unit that has been confirmed to have a sheet, turns the excitation current of the paper feeding motor 301 to the OFF condition, and returns the process to the step S102.

Next, the details of the lifter control process in the step S112 in FIG. 7 will be described.

Figure 9:
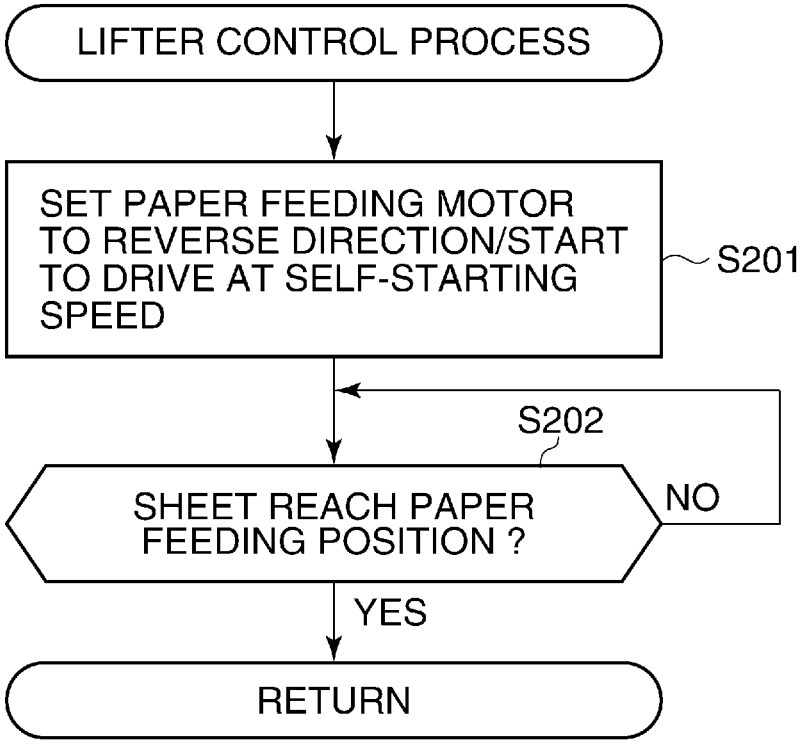
FIG. 9 is a flowchart showing details of a lifter control process executed in step S112 in FIG. 7.

FIG. 9 is a flowchart showing the details of the lifter control process executed in the step S112 in FIG. 7.

First, in step S201, the CPU 101 sets the rotating direction of the paper feeding motor 301 of the paper feeding unit that has been confirmed to have a sheet to the reverse direction, and starts the drive of the paper feeding motor at a self-starting speed. The drive of the paper feeding motor at the self-starting speed means driving the paper feeding motor 301 at the self-starting frequency mentioned above.

Figure 11:
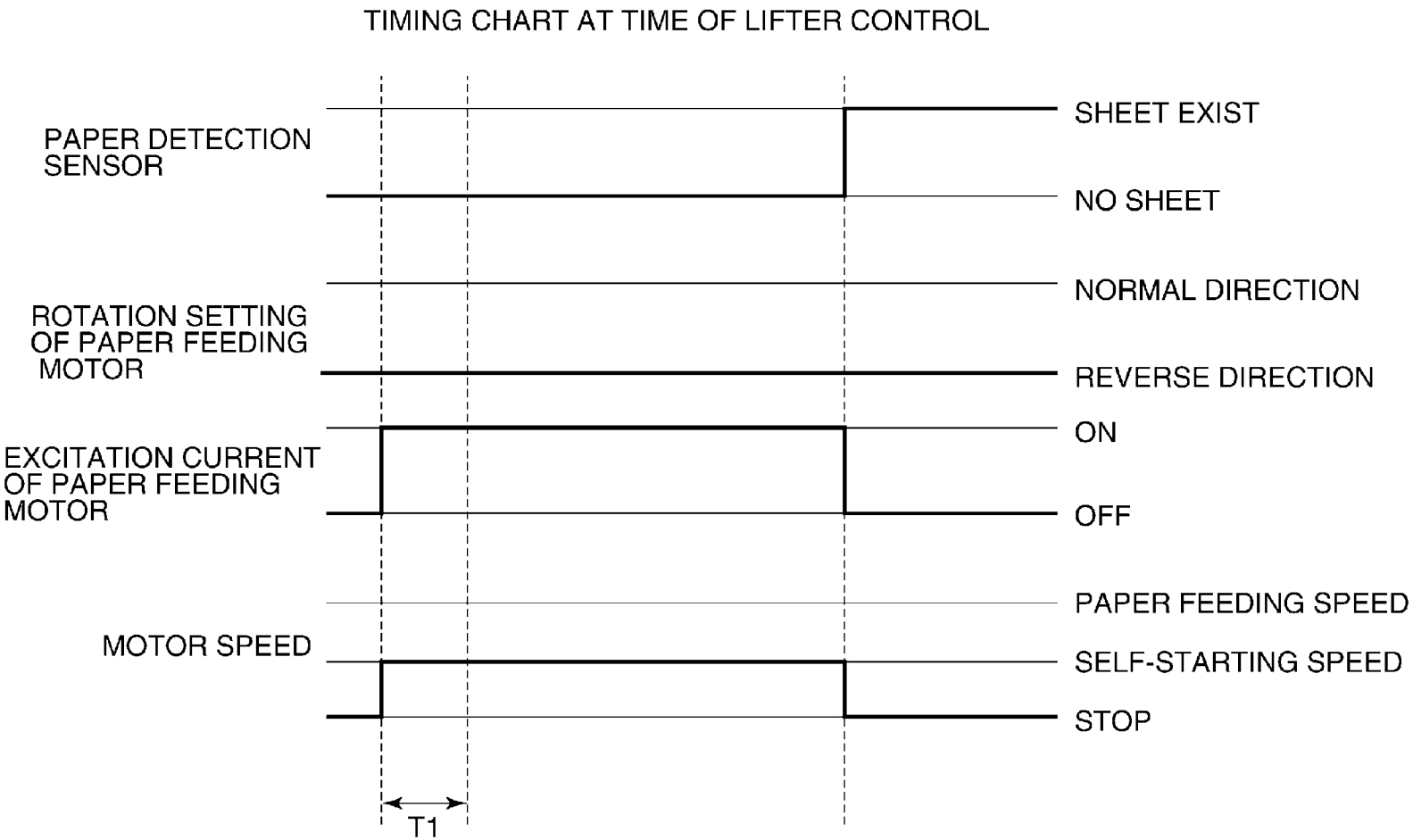
FIG. 11 is a timing chart showing a detection result of the paper detection sensor, a rotation setup of the paper feeding motor, the excitation current, and a speed at the time of the lifter control in the digital copier in FIG. 1.

After the step S201, the CPU 101 waits until the sheet is lifted up to the paper feeding position in step S202. That is, when the tray 2102 is lifted up by the drive of the paper feeding motor 301 in the reverse direction and the top face of the sheet on the tray 2102 reaches the position of the paper detection sensor 2100, the process is returned to the flowchart in FIG. 7. FIG. 11 is a timing chart showing the detection result of the paper detection sensor, the rotation setup of the paper feeding motor 301, the excitation current, and the speed at this time.

In FIG. 11, a time interval means 100 ms after the excitation current turns ON in the step S111. When the top face of the sheet reaches the position of the paper detection sensor and the paper detection sensor detects the sheet, the paper feeding motor 301 that has been rotating in the self-starting speed is stopped.

In the case in FIG. 11, the excitation current of the paper feeding motor is turned ON (S110), the lifter control process in FIG. 9 is executed in the step S112 after waiting 100 ms (T1, S111). Then, the paper feeding motor rotates in the reverse direction at the self-starting speed (S201), and when the output of the paper detection sensor becomes "sheet exist" (S202, YES), the process returns to the step S113 to stop the paper feeding motor, and to turn the excitation current OFF.

Next, the details of the paper feed control process in the step S107 in FIG. 7 will be described.

Figure 10A:
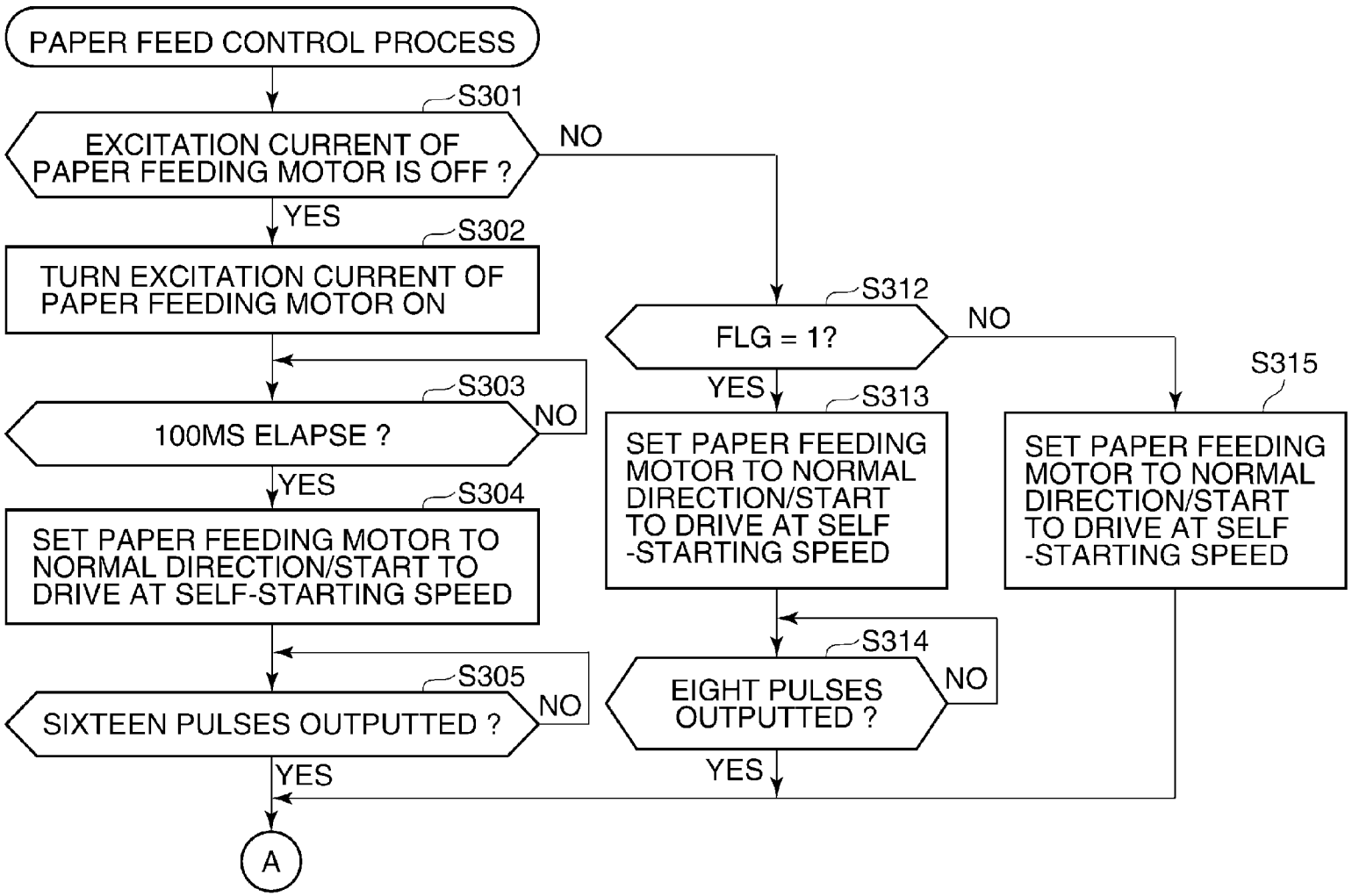
FIG. 10A and FIG. 10B are flowcharts showing a paper feed control process executed in step S107 in FIG. 7.
Figure 10B:
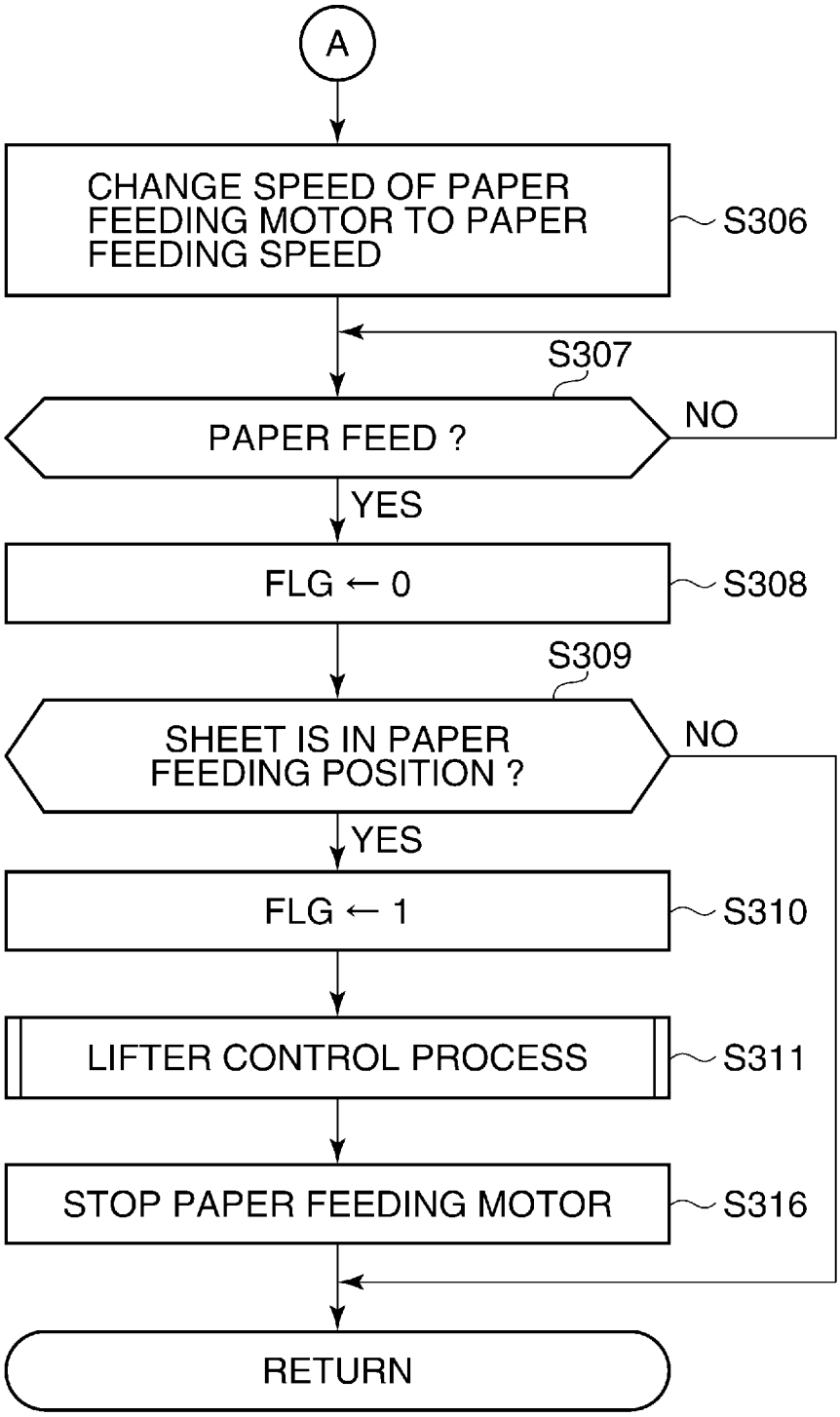

FIG. 10A and FIG. 10B are flowcharts showing the paper feed control process executed in the step S107 in FIG. 7.

First, in step S301, the CPU 101 determines whether the excitation current of the paper feeding motor 301 of the paper feeding unit that has been confirmed to have a sheet is under the OFF condition. When determining that the excitation current of the paper feeding motor 301 of the paper feeding unit that has been confirmed to have a sheet is under the OFF condition as a result of the determination in the step S301, the process proceeds to step S302. On the other hand, when the excitation current is not under the OFF condition, i.e., it is under the ON condition, the process proceeds to step S312.

In the step S302, the CPU 101 turns the excitation current ON for the paper feeding motor 301 of the paper feeding unit that has been confirmed to have a sheet. Then, the CPU 101 waits for a lapse of 100 ms (step S303). After the lapse of 100 ms, the CPU 101 sets the rotating direction of the paper feeding motor 301 of the paper feeding unit that has been confirmed to have a sheet to the normal rotation direction, and starts the drive of the paper feeding motor at the above-mentioned self-starting speed (step S304). Next, the CPU 101 waits until the number of accumulated clock pulses at the self-starting frequency inputted into the motor becomes sixteen pulses (step S305). When the number of accumulated clock pulses inputted into the motor becomes sixteen pulses (YES in the step S305), the CPU 101 changes the speed of the paper feeding motor 301 to a paper feeding speed (a sheet feeding speed) that is a target speed (step S306). The process in the steps S304 through S306 is specifically executed as follows. Namely, when a first sheet is fed after the excitation current for the paper feeding motor 301 is switched on from off, the CPU 101 executes a first initial operation in which the paper feeding motor 301 is driven at the self-starting speed (an initial starting speed) until the number of accumulated clock pulses reaches sixteen (a first pulse number), and then, the CPU 101 changes the speed of the paper feeding motor to the paper feeding speed. The process in the steps S304 through S306 is an example of a first control process. Before the first sheet is fed, since the excitation current of the motor is turned OFF and the weight of the sheets on the tray applies a force to the gears of the paper feeding drive transmission unit, the electric phase of the motor deviates from the phase of the excitation current and the gear gap is generated in the paper feeding drive transmission unit. Therefore, when the first sheet is fed after the excitation current for the paper feeding motor 301 is switched on from off, the paper feeding motor 301 is driven at the initial starting speed, for the purpose of matching the electric phases and canceling the gear gap, until the clock pulses of the first pulse number are inputted.

In step S307, the CPU 101 waits until the paper has been fed. When a paper feeding sensor (not shown) detects that a sheet is removed from the paper feeding unit that has been confirmed to have a sheet, the CPU 101 determines that the paper has been fed. When determining that the paper has been fed in the step S307, the CPU 101 clears the internal flag (FLG=0) of the paper feeding unit that has been confirmed to have a sheet (step S308).

Next, the CPU 101 determines whether a sheet in the paper feeding unit that has been confirmed to have a sheet is in the paper feeding position as with the step S102 (step S309). When the CPU 101 determines that the sheet is in the paper feeding position as a result of the determination in the step S309, the process returns. On the other hand, when determining that the sheet is not in the paper feeding position, the CPU 101 sets "1" to the internal flag (FLG=1) of the paper feeding unit that has been confirmed to have a sheet (step S310). Next, the CPU 101 executes the above-mentioned lifter control process (step S311), and when the sheet reaches the paper feeding position (S202, YES), the CPU 101 stops the paper feeding motor without turning the excitation current OFF (S316), and returns the process to the flowchart in FIG. 7.

In step S312, the CPU 101 determines whether the internal flag of the paper feeding unit that has been confined to have a sheet is "1". When determining that the internal flag of the paper feeding unit that has been confirmed to have a sheet is "1" as a result of the determination in the step S312 (when the lifter control process has been executed before the paper feeding at this time), the process proceeds to step S313. If not, the process proceeds to step S315.

In the step S313, the CPU 101 sets the rotating direction of the paper feeding motor 301 of the paper feeding unit that has been confirmed to have a sheet to the normal rotation direction, and starts the drive of the paper feeding motor at the above-mentioned self-starting speed. Next, the CPU 101 waits until the number of accumulated clock pulses at the self-starting frequency inputted into the motor becomes eight pulses (step S314) as shown in FIG. 5. When the number of accumulated clock pulses inputted into the motor becomes eight (YES in the step S314), the CPU 101 executes a process from the step S306.

The process in the step S313, S314, and S306 are specifically as follows. Namely, when the paper feeding mechanism feeds a sheet without turning off the excitation current for the paper feeding motor 301 after the lifting mechanism lifts the tray 2102 (when the second and later sheets are fed and the lift-up operation has been executed after feeding the previous sheet), a second initial operation in which the paper feeding motor 301 is driven at the self-starting speed (the initial starting speed) until the number of accumulated clock pulses, which are inputted to the motor, reaches eight (a second pulse number) is executed. Then, the speed of the paper feeding motor 301 is changed to the paper feeding speed. The process in the steps S313, S314, and S306 is an example of a second control process. Thus, when the second and later sheets are fed and the lift-up operation has been executed after feeding the previous sheet, the electric phase matching of the motor is unnecessary because the excitation current of the motor is not turned OFF. However, there is a necessity to cancel the gear gap in the paper feeding drive transmission unit when switching the rotating direction of the paper feeding motor from the reverse direction to the normal direction. Then, when the second and later sheets are fed and the lift-up operation has been executed after feeding the previous sheet, the paper feeding motor 301 is driven at the initial starting speed in order to cancel the gear gap until the clock pulses of the second pulse number are inputted. Therefore, the second pulse number is smaller than the first pulse number.

In step S315, the CPU 101 sets the rotating direction of the paper feeding motor 301 of the paper feeding unit that has been confirmed to have a sheet to the normal rotation direction, and starts the drive of the paper feeding motor from the self-starting speed. After the step S315, the speed of the paper feeding motor 301 is changed to the paper feeding speed that is the target speed (step S306), and the process proceeds to the step S307. The process from the step S315 to the step S307 is specifically executed as follows. Namely, when the paper feeding mechanism feeds a sheet without turning off the excitation current for the paper feeding motor 301 after the paper feeding mechanism feeds a previous sheet (when the second and later sheets are fed and the lift-up operation has not been executed after feeding the previous sheet), the paper feeding motor 301 is accelerated by changing the speed from the self-starting speed to the paper feeding speed without executing the first and second initial operations.

When the second and later sheets are fed and the lift-up operation has not been executed after feeding the previous sheet, the speed of the paper feeding motor 301 may be changed to the paper feeding speed after executing a third initial operation in which the paper feeding motor 301 is driven at the self-starting speed until the number of accumulated clock pulses inputted into the motor reaches a third pulse number. The process from the step S315 to the step S307 is an example of a third control process. Thus, when the second and later sheets are fed and the lift-up operation has not been executed after feeding the previous sheet, the speed of the paper feeding motor 301 is changed from the initial starting speed to the paper feeding speed because the electric phase matching and the cancellation of the gear gap are unnecessary. Alternatively, the speed of the paper feeding motor 301 is changed to the paper feeding speed after driving the paper feeding motor 301 at the initial starting speed until the clock pulses of the third pulse number is inputted. In this case, the third pulse number is smaller than the second pulse number.

Next, the detection result of the paper detection sensor, the rotation setup of the paper feeding motor 301, the excitation current, and the speed in the paper feed control process mentioned above will be described using timing charts in FIG. 12, FIG. 13, and FIG. 14.

Figure 12:
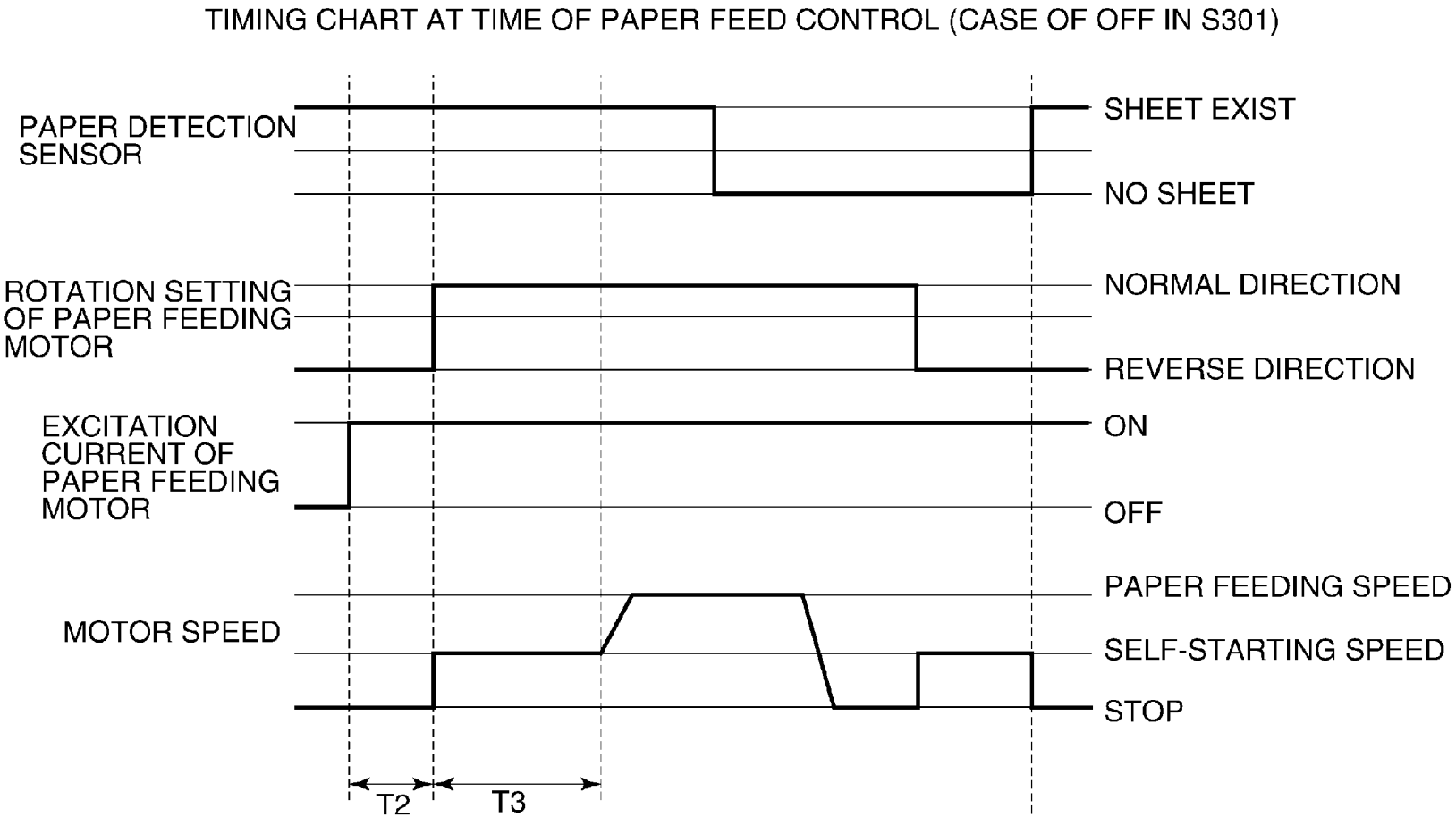
FIG. 12 is a timing chart showing the detection result of the paper detection sensor, the rotation setup of the paper feeding motor, the excitation current, and the speed when feeding a first sheet in the digital copier in FIG. 1.

FIG. 12 is a timing chart showing the detection result of the paper detection sensor, the rotation setup of the paper feeding motor 301, the excitation current, and the speed when determining that the excitation current of the paper feeding motor of the paper feeding unit that has been confirmed to have a sheet is under the OFF condition (when feeding a first sheet) in the step S301.

In FIG. 12, a time interval T2 means 100 ms after the excitation current turns ON in the step S303. A reference symbol T3 denotes a time interval required of the initial operation of the paper feeding motor, and is a time until the number of accumulated clock pulses becomes sixteen pulses in the step S305.

In the case of FIG. 12, the excitation current of the paper feeding motor is turned ON (S302), the paper feeding motor rotates at the self-starting speed in the normal direction (S304) after the standby of 100 ms (S303, T2). Then, the paper feeding motor is accelerated to the paper feeding speed (S306) after waiting until the sixteen clock pulses are outputted (S305, T3). When the paper has been fed (S307, YES) and when determining that the output of the paper detection sensor becomes "no sheet", that is, the sheet is not in the paper feeding position (S309, NO), the lifter control process in FIG. 9 is executed in the step S311, the paper feeding motor rotates at the self-starting speed in the reverse direction (S201). When the output of the paper detection sensor varies to mean "sheet exist" (S202, YES), the process returns to the step S316 and the paper feeding motor is stopped.

Figure 13:
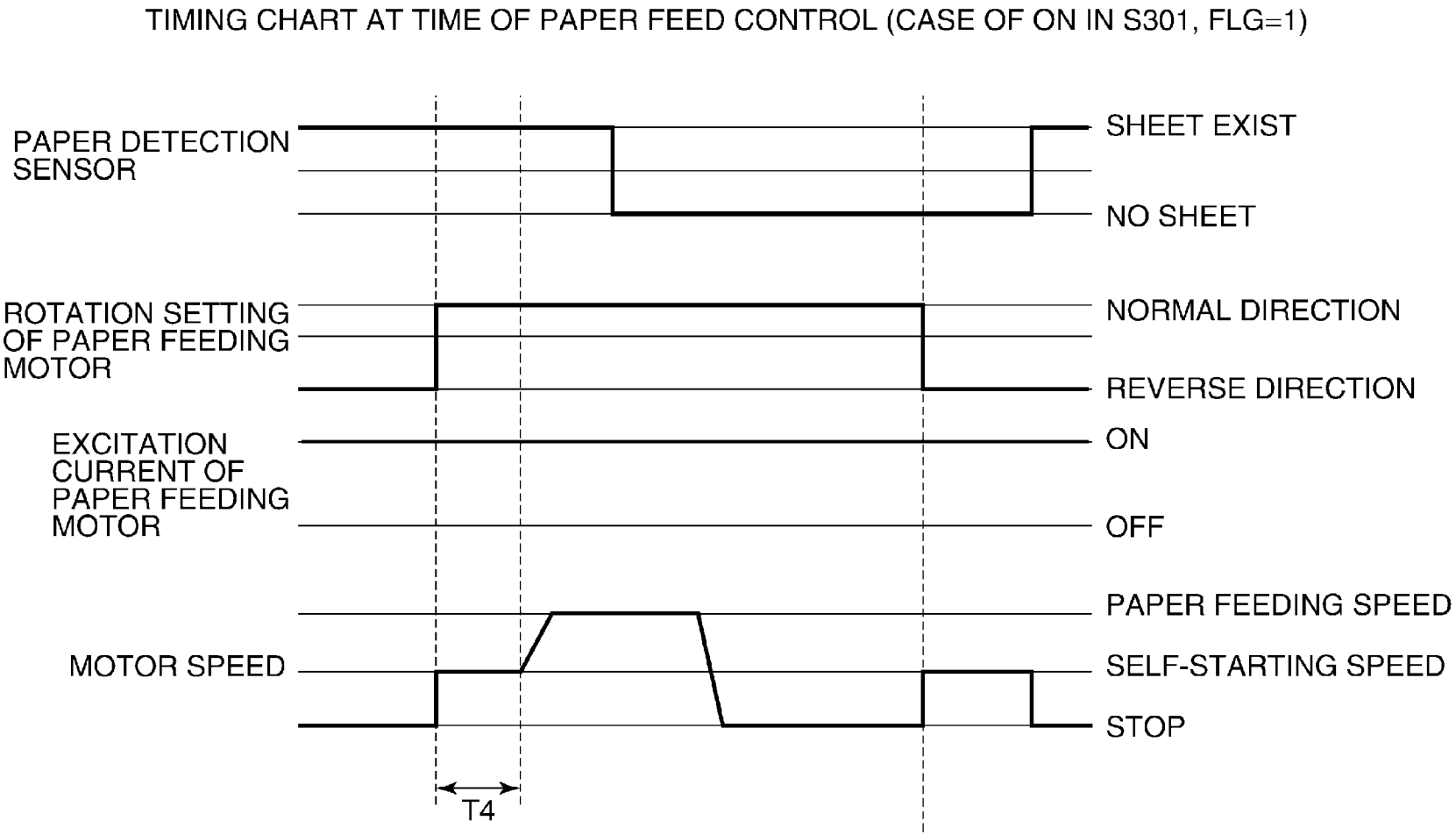
FIG. 13 is a timing chart showing the detection result of the paper detection sensor, the rotation setup of the paper feeding motor, the excitation current, and the speed when the lift mechanism has lifted the tray up after finishing a previous paper feeding and when feeding second and later sheets in the digital copier in FIG. 1.

FIG. 13 is a timing chart showing the detection result of the paper detection sensor, the rotation setup of the paper feeding motor 301, the excitation current, and the speed, when determining that the excitation current of the paper feeding motor is under the ON condition and when the internal flag FLG is "1" in the step S312 (when feeding second and later sheets, and when the lifter control has been executed just before feeding the present sheet).

In FIG. 13, a reference symbol T4 denotes a time interval required of the initial operation of the paper feeding motor as with the T3, and is a time until the number of accumulated clock pulses becomes eight pulses in the step S314.

In the case of FIG. 13, the paper feeding motor rotates at the self-starting speed in the normal direction (S313), and the paper feeding motor is accelerated to the paper feeding speed (S306) after waiting until eight clock pulses are outputted (S314, T4). When the paper has been fed (S307, YES) and when determining that the output of the paper detection sensor becomes "no sheet", that is, the sheet is not in the paper feeding position (S309, NO), the lifter control process in FIG. 9 is executed in the step S311, the paper feeding motor rotates at the self-starting speed in the reverse direction (S201). When the output of the paper detection sensor varies to mean "sheet exist" (S202, YES), the process returns to the step S316 and the paper feeding motor is stopped.

Figure 14:
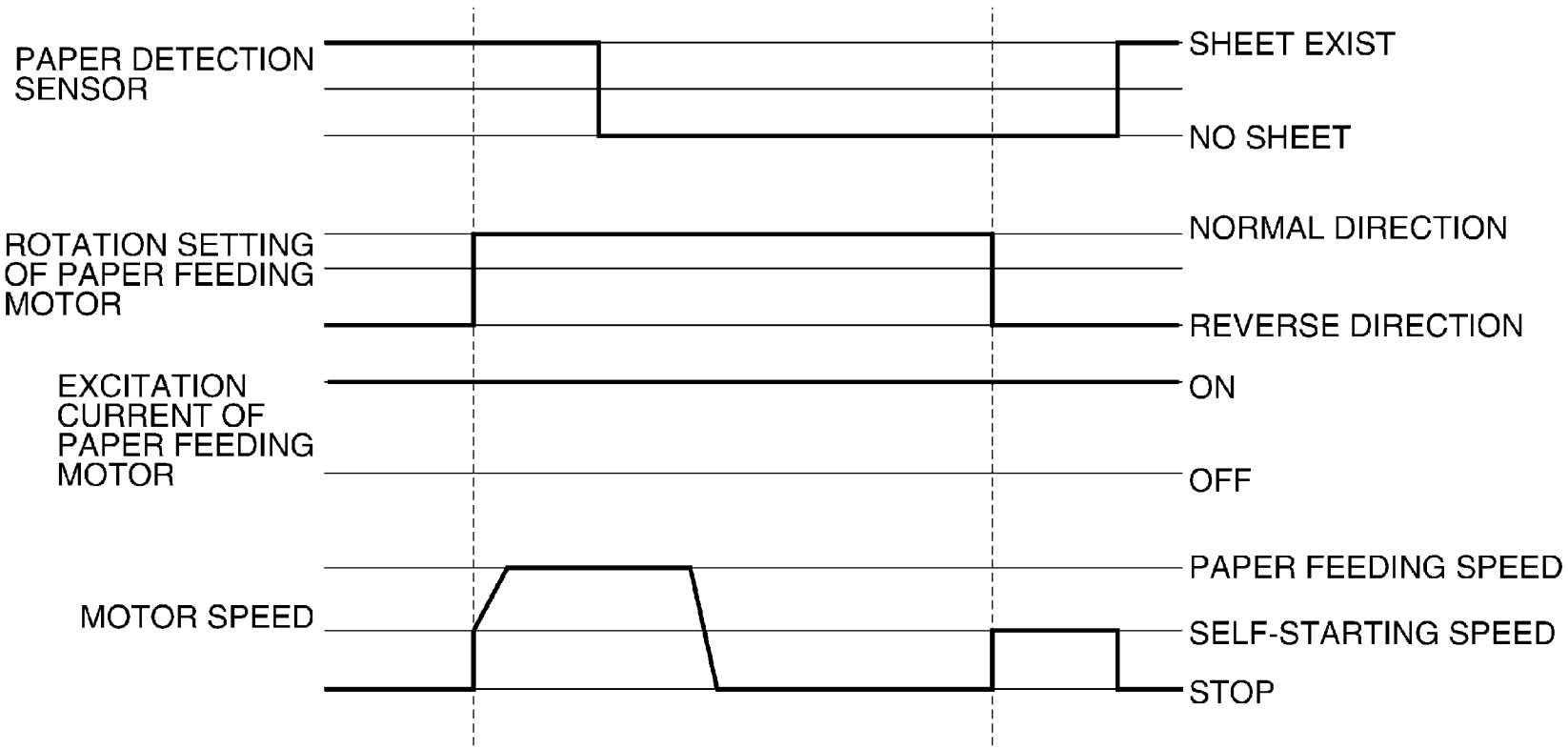
FIG. 14 is a timing chart showing the detection result of the paper detection sensor, the rotation setup of the paper feeding motor, the excitation current, and the speed when the lift mechanism has not lifted the tray up after finishing a previous paper feeding and when feeding second and later sheets in the digital copier in FIG. 1.

FIG. 14 is a timing chart showing the detection result of the paper detection sensor, the rotation setup of the paper feeding motor 301, the excitation current, and the speed, when determining that the excitation current of the paper feeding motor is under the ON condition and when the internal flag FLG is "0" in the step S312 (when feeding second and later sheets, and when the lifter control has not been executed just before feeding the present sheet).

The timing chart in FIG. 14 shows a pattern that does not need the initial operation shown in FIG. 5, and the speed of the paper feeding motor is immediately accelerated from the self-starting speed to the paper feeding speed.

In the case of FIG. 14, the paper feeding motor rotates in the normal direction at the paper feeding speed (S315). When the paper has been fed (S307, YES) and when determining that the output of the paper detection sensor becomes "no sheet", that is, the sheet is not in the paper feeding position (S309, NO), the lifter control process in FIG. 9 is executed in the step S311, the paper feeding motor rotates at the self-starting speed in the reverse direction (S201). When the output of the paper detection sensor varies to mean "sheet exist" (S202, YES), the process returns to the step S316 and the paper feeding motor is stopped.

According to this embodiment, when different driven objects are driven by a normal rotation and a reverse rotation of a cheap PM-type stepping motor, for example, even if a backlash of mechanical gears occurs due to the sharing of the motor for the lift-up operation and the paper feeding operation, the motor can be driven without causing step-out.

Since an unnecessary initial operation is not performed, it is possible to increase the productivity when feeding paper.

Other Embodiments

Aspects of the present invention can also be realized by a computer of a system or apparatus (or devices such as a CPU or MPU) that reads out and executes a program recorded on a memory device to perform the functions of the above-described embodiment(s), and by a method, the steps of which are performed by a computer of a system or apparatus by, for example, reading out and executing a program recorded on a memory device to perform the functions of the above-described embodiment(s). For this purpose, the program is provided to the computer for example via a network or from a recording medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2009-175487, filed on Jul. 28, 2009, and No. 2010-158777, filed on Jul. 13, 2010, which are hereby incorporated by reference herein in their entireties.

What is claimed is:

1. A sheet feeding apparatus that feeds a sheet, the sheet feeding apparatus comprising:

a sheet feeding unit configured to include a tray that stacks sheets to be fed, a sheet feeding mechanism that conveys the sheets stacked on the tray on a one-by-one basis, a lifting mechanism that lifts the tray so that the sheet is positioned in a sheet feeding position suitable for feeding, a stepping motor that drives the sheet feeding mechanism and the lifting mechanism, and a switching mechanism that switches an operation of the sheet feeding mechanism and an operation of the lifting mechanism according to a rotating direction of the stepping motor; and a control unit configured to control said sheet feeding unit, wherein, while the sheet feeding mechanism is feeding a sheet after excitation current for the stepping motor is switched on from off, said control unit executes a first initial operation in which the stepping motor is driven at an initial starting speed until an accumulated number of pulses reaches a first predetermined pulse number, and then changes the speed of the stepping motor to a sheet feeding speed, wherein, while the sheet feeding mechanism is feeding a sheet without turning off the excitation current for the stepping motor after the lifting mechanism lifts the tray, said control unit executes a second initial operation in which the stepping motor is driven at the initial starting speed until the accumulated number of pulses reaches a second predetermined pulse number, and then changes the speed of the stepping motor to the sheet feeding speed, and wherein said control unit changes the speed of the stepping motor from the initial starting speed to the sheet feeding speed without executing the first and second initial operations, when the sheet feeding mechanism feeds a sheet without turning off the excitation current for the stepping motor after the sheet feeding mechanism feeds a previous sheet.

2. The sheet feeding apparatus according to claim 1, wherein the switching mechanism operates the sheet feeding mechanism by setting the rotating direction of the stepping motor to a normal direction, and operates the lifting mechanism by setting the rotating direction of the stepping motor to a reverse direction.

3. The sheet feeding apparatus according to claim 1, wherein the second predetermined pulse number is smaller than the first predetermined pulse number.

4. An image forming apparatus comprising:

the sheet feeding apparatus according to claim 1; and an image forming unit configured to form an image on the sheet fed by said sheet feeding apparatus.

5. A sheet feeding apparatus that feeds a sheet, the sheet feeding apparatus comprising:

a sheet feeding unit configured to include a tray that stacks sheets to be fed, a sheet feeding mechanism that conveys the sheets stacked on the tray on a one-by-one basis, a lifting mechanism that lifts the tray so that the sheet is positioned in a sheet feeding position suitable for feeding, a stepping motor that drives the sheet feeding mechanism and the lifting mechanism, and a switching mechanism that switches an operation of the sheet feeding mechanism and an operation of the lifting mechanism according to a rotating direction of the stepping motor; and a control unit configured to control said sheet feeding unit, wherein, while the sheet feeding mechanism is feeding a sheet after excitation current for the stepping motor is switched on from off, said control unit drives the stepping motor at an initial starting speed until an accumulated number of pulses reaches a first predetermined pulse number, and then changes the speed of the stepping motor to a sheet feeding speed, wherein, while the sheet feeding mechanism is feeding a sheet without turning off the excitation current for the stepping motor after the lifting mechanism lifts the tray, said control unit drives the stepping motor at the initial starting speed until the accumulated number of pulses reaches a second predetermined pulse number, and then changes the speed of the stepping motor to the sheet feeding speed, and wherein, while the sheet feeding mechanism is feeding a sheet without turning off the excitation current for the stepping motor after the sheet feeding mechanism feeds a previous sheet, said control unit drives the stepping motor at the initial starting speed until the accumulated number of pulses reaches a third predetermined pulse number, and then changes the speed of the stepping motor to the sheet feeding speed.

6. The sheet feeding apparatus according to claim 5, wherein the switching mechanism operates the sheet feeding mechanism by setting the rotating direction of the stepping motor to a normal direction, and operates the lifting mechanism by setting the rotating direction of the stepping motor to a reverse direction.

7. The sheet feeding apparatus according to claim 5, wherein the second predetermined pulse number is smaller than the first predetermined pulse number, and the third predetermined pulse number is smaller than the second predetermined pulse number.

8. The sheet feeding apparatus according to claim 5, wherein said control unit turns an excitation current of the stepping motor off before feeding a first sheet.

9. An image forming apparatus comprising:

a sheet feeding apparatus; and an image forming unit configured to form an image on a sheet fed by said sheet feeding apparatus, wherein the sheet feeding apparatus includes:

a sheet feeding unit configured to include a tray that stacks sheets to be fed, a sheet feeding mechanism that conveys the sheets stacked on the tray on a one-by-one basis, a lifting mechanism that lifts the tray so that the sheet is positioned in a sheet feeding position suitable for feeding, a stepping motor that drives the sheet feeding mechanism and the lifting mechanism, and a switching mechanism that switches an operation of the sheet feeding mechanism and an operation of the lifting mechanism according to a rotating direction of the stepping motor; and a control unit configured to control said sheet feeding unit, wherein, while the sheet feeding mechanism is feeding a sheet after excitation current for the stepping motor is switched on from off, said control unit drives the stepping motor at an initial starting speed until an accumulated number of pulses reaches a first predetermined pulse number, and then changes the speed of the stepping motor to a sheet feeding speed, wherein, while the sheet feeding mechanism is feeding a sheet without turning off the excitation current for the stepping motor after the lifting mechanism lifts the tray, said control unit drives the stepping motor at the initial starting speed until the accumulated number of pulses reaches a second predetermined pulse number, and then changes the speed of the stepping motor to the sheet feeding speed, and wherein, while the sheet feeding mechanism is feeding a sheet without turning off the excitation current for the stepping motor after the sheet feeding mechanism feeds a previous sheet, said control unit drives the stepping motor at the initial starting speed until the accumulated number of pulses reaches a third predetermined pulse number, and then changes the speed of the stepping motor to the sheet feeding speed.

10. An image forming apparatus comprising:

a sheet feeding apparatus; and an image forming unit configured to form an image on a sheet fed by said sheet feeding apparatus, wherein the sheet feeding apparatus includes:

a sheet feeding unit configured to include a tray that stacks sheets to be fed, a sheet feeding mechanism that conveys the sheets stacked on the tray on a one-by-one basis, a lifting mechanism that lifts the tray so that the sheet is positioned in a sheet feeding position suitable for feeding, a stepping motor that drives the sheet feeding mechanism and the lifting mechanism, and a switching mechanism that switches an operation of the sheet feeding mechanism and an operation of the lifting mechanism according to a rotating direction of the stepping motor; and a control unit configured to control said sheet feeding unit, wherein, while the sheet feeding mechanism is feeding a sheet after excitation current for the stepping motor is switched on from off, said control unit executes a first initial operation in which the stepping motor is driven at an initial starting speed until an accumulated number of pulses reaches a first predetermined pulse number, and then changes the speed of the stepping motor to a sheet feeding speed, wherein, while the sheet feeding mechanism is feeding a sheet without turning off the excitation current for the stepping motor after the lifting mechanism lifts the tray, said control unit executes a second initial operation in which the stepping motor is driven at the initial starting speed until the accumulated number of pulses reaches a second predetermined pulse number, and then changes the speed of the stepping motor to the sheet feeding speed, and wherein said control unit changes the speed of the stepping motor from the initial starting speed to the sheet feeding speed without executing the first and second initial operations, when the sheet feeding mechanism feeds a sheet without turning off the excitation current for the stepping motor after the sheet feeding mechanism feeds a previous sheet.

* * * * *